US008152374B2

(12) United States Patent
Shaul

(10) Patent No.: US 8,152,374 B2
(45) Date of Patent: Apr. 10, 2012

(54) PROTECTIVE COVER FOR BACKPACKS

(76) Inventor: Barry C. Shaul, Rome (IT)

( * ) Notice: Subject to any disclaimer, the term of this patent is extended or adjusted under 35 U.S.C. 154(b) by 474 days.

(21) Appl. No.: 12/382,156

(22) Filed: Mar. 10, 2009

(65) Prior Publication Data

US 2010/0232731 A1 Sep. 16, 2010

(51) Int. Cl.

| | |
|---|---|
| ***B65D 30/00*** | (2006.01) |
| ***B65D 33/16*** | (2006.01) |
| ***B65D 65/02*** | (2006.01) |
| ***A45C 3/08*** | (2006.01) |
| ***A45C 13/08*** | (2006.01) |
| ***A45F 4/02*** | (2006.01) |
| ***A45F 3/04*** | (2006.01) |

(52) U.S. Cl. ..... 383/37; 383/64; 150/154; 150/105; 224/153; 224/645; 224/654; 224/627

(58) Field of Classification Search ..... 383/37, 383/64; 150/154, 105; 224/153, 645, 654, 224/627

See application file for complete search history.

(56) References Cited

U.S. PATENT DOCUMENTS

| | | | | |
|---|---|---|---|---|
| 3,960,300 | A | 6/1976 | Dickler | |
| 4,213,549 | A * | 7/1980 | Hibbard | 224/601 |
| 4,333,591 | A * | 6/1982 | Case | 224/160 |
| 5,009,516 | A * | 4/1991 | Geeck | 383/37 |
| 5,010,987 | A * | 4/1991 | Evans | 190/26 |
| 5,154,332 | A | 10/1992 | Williams et al. | |
| 5,209,279 | A * | 5/1993 | Wilson | 150/111 |
| 5,439,153 | A | 8/1995 | Murdoch et al. | |
| 6,026,662 | A | 2/2000 | Schlipper | |
| 6,138,881 | A * | 10/2000 | Paul et al. | 224/153 |
| 6,244,081 | B1 | 6/2001 | Schlipper | |
| 6,279,796 | B1 | 8/2001 | Trevino | |
| 6,543,658 | B2 * | 4/2003 | Trevino | 224/153 |
| 6,637,562 | B2 | 10/2003 | Oh | |
| D509,653 | S | 9/2005 | Yu | |
| D513,879 | S | 1/2006 | Waples | |
| 7,093,699 | B2 * | 8/2006 | Yu | 190/26 |
| 7,374,071 | B2 * | 5/2008 | Lavelle | 224/153 |
| 7,422,131 | B2 * | 9/2008 | Cohen | 224/654 |
| 2004/0022455 | A1 * | 2/2004 | Reason | 383/5 |
| 2004/0206431 | A1 * | 10/2004 | Metzig et al. | 150/154 |
| 2005/0133558 | A1 * | 6/2005 | Toombs | 224/576 |
| 2005/0163403 | A1 * | 7/2005 | Piscioneri | 383/108 |
| 2005/0199658 | A1 | 9/2005 | Brown et al. | |
| 2005/0205635 | A1 * | 9/2005 | Cohen | 224/652 |
| 2006/0032883 | A1 | 2/2006 | Moreno | |
| 2006/0151560 | A1 * | 7/2006 | Chen | 224/645 |
| 2006/0289590 | A1 | 12/2006 | Held | |

(Continued)

FOREIGN PATENT DOCUMENTS

| | | | |
|---|---|---|---|
| JP | 2000210123 | A * | 8/2000 |
| JP | 2004016621 | A * | 1/2004 |

*Primary Examiner* — Nathan J Newhouse
*Assistant Examiner* — Latrice Byrd
(74) *Attorney, Agent, or Firm* — Stein McEwen, LLP

(57) ABSTRACT

The invention pertains to a protective cover for a backpack, the cover preventing unauthorized access to the backpack and its contents. Apertures and slots are formed in the protective cover to allow the straps on the backpack to pass through the cover, so that the protective cover and backpack can be retained on the shoulders of the user. A single, elongated zipper on the protective cover provides access to the interior thereof, and the end point of the zipper is hidden from view when resting upon the back of the user.

6 Claims, 5 Drawing Sheets

U.S. PATENT DOCUMENTS

2007/0062996 A1 3/2007 Miles et al.
2007/0102460 A1* 5/2007 Lottman ..... 224/153
2007/0235480 A1 10/2007 Russo et al.
2007/0240798 A1* 10/2007 Bihler ..... 150/102

* cited by examiner

PROTECTIVE COVER FOR BACKPACKS

FIELD OF THE INVENTION

The instant invention pertains to a protective cover for a back pack, such cover preventing unauthorized access to the back pack and its contents.

BACKGROUND OF THE INVENTION

Back packs are worn by travelers, students, hikers, etc., and are usually held in position by a pair of vertically oriented straps passing around the shoulders of the wearer. The free ends of each strap are usually joined together by a buckle, so that the length of each strap can be adjusted and the back pack rests comfortably upon the back of the wearer.

The back pack may contain valuable items, such as laptop computers and cameras, in addition to fresh clothing, worn clothing, toiletries, reading material, film, etc. At least one zipper, which may encircle the back pack in a horizontal, or vertical direction, is opened to provide access to the contents of the back pack. The zipper may be replaced by buttons, snaps, Velcro fasteners, etc., but the problem of unauthorized entry into the backpack remains unsolved.

Whereas the zipper provides access to authorized persons, including the wearer, the same zipper provides a readily accessible point of entry of thieves, pick pockets, and other unauthorized persons. The problem of unauthorized entry is exacerbated because the slider for the zipper is visible to persons walking behind the wearer, yet out of the view of the wearer, so that thieves, etc. may pilfer or damage the contents without being observed by the wearer of the back pack.

Diverse covers have been proposed for protecting a back pack, and its contents, from unauthorized entry. To illustrate, U.S. Pat. No. 5,154,352, granted Oct. 13, 1992, to C. W. Williamsen et al, discloses a fabric enclosure, or cover, 16 that accommodates back pack 58, as shown in FIG. 5. The cover is secured in place by straps 52 that pass around the shoulders of the wearer. Interlocking zippers 14*a*, 14*b* and 14*c*, can be interconnected by shackle 46, 48 as shown in FIG. 3A to prevent unauthorized opening of the enclosure to gain access to back pack 58.

U.S. Patent Application Publication 2005/0133558 discloses a multiple-use cover 20 with an easy opening zipper used to cover an article 10, such as a backpack. Zipper 23 and flap opening 30, allow the user to gain access to the contents of the backpack, without having to remove the cover from the pack, so that the wearer can pass quickly through inspection lines at an airport and other security check points.

U.S. Pat. No. 6,279,796, granted Aug. 28, 2001, to Jose Trevino, discloses a protective cover 10, with a drawstring 17 at its lower end, that allows the cover to be slipped over the back pack 2 to protect the back pack, and its contents, from damage from weather exposure.

Known protective devices, however, have proven to be largely ineffective in defeating unauthorized entry into back packs and tampering with the contents of the back pack.

SUMMARY OF THE INVENTION

Applicant's invention provides a unitary protective cover that conceals known back packs of different sizes and shapes, and defeats unauthorized entry into the back packs. The protective cover is formed of a sturdy, attractive fabric, and the exterior of the cover may be embellished by team logos, advertisements, or slogans, that personalize the cover.

Applicant's protective cover includes two slots and two apertures for allowing the straps on the back pack to pass through the cover. The straps, on the back pack, are secured about the body of the wearer, particularly the shoulders, and serve to fasten the protective cover and enclosed back pack, on the body of the wearer.

Applicant's protective cover effectively conceals all zippers, and/or other points of entry, into the back pack retained within the confines of the cover. An elongated zipper closes the protective cover, and the access point for the zipper is located on the front section of the cover abutting the wearer's back. Thus, thieves or pick pockets, in the vicinity of the wearer, cannot see, or reach, the elongated zipper to open same and gain access to the back pack retained within the protective cover, when the protective cover is retained on one's back.

The single elongated zipper on the protective cover extends approximately the midpoint of the rear section of the cover, over the top of the cover, and down the front section of the cover. The elongated zipper, when opened, provides ease of entry for backpacks of various sizes. A D-clasp, a swivel hook, and a lock, may be employed to retain the zipper in locked position, as an additional precaution against unauthorized entry into the protective cover and the back pack retained therein. The zipper may also be hidden from view by a flap that blends in which the decor of the protective cover.

Other objects and advantages realized by applicant's protective cover will be readily apparent to the skilled artisan from inspection of the attached drawings and consideration of the ensuing specification.

DETAILED DESCRIPTION OF THE DRAWINGS

DETAILED DESCRIPTION

Figure 1:
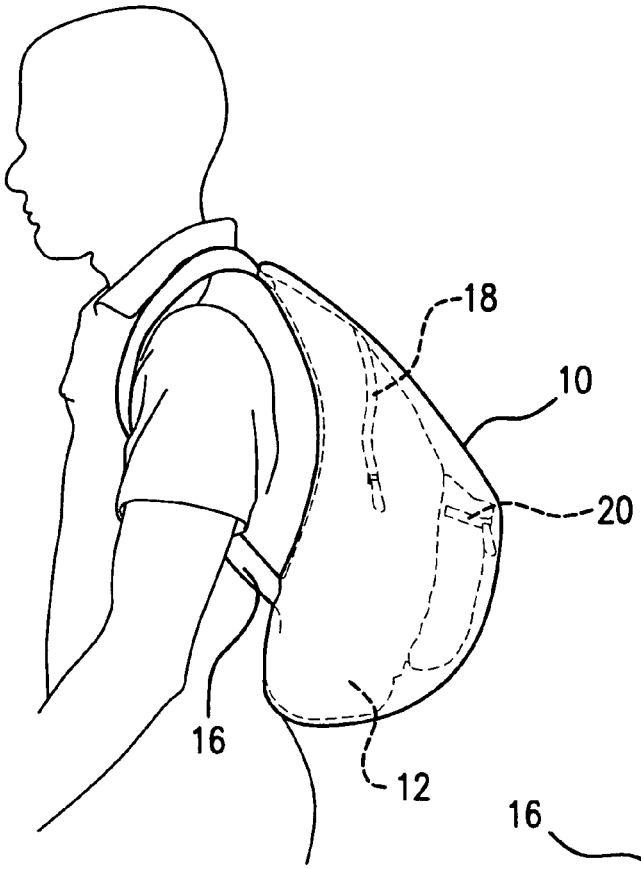
FIG. 1 is a side elevational view of a cover for a backpack worn by a traveler, the cover being shown in solid lines while the backpack is shown in phantom outline.
Figure 2:
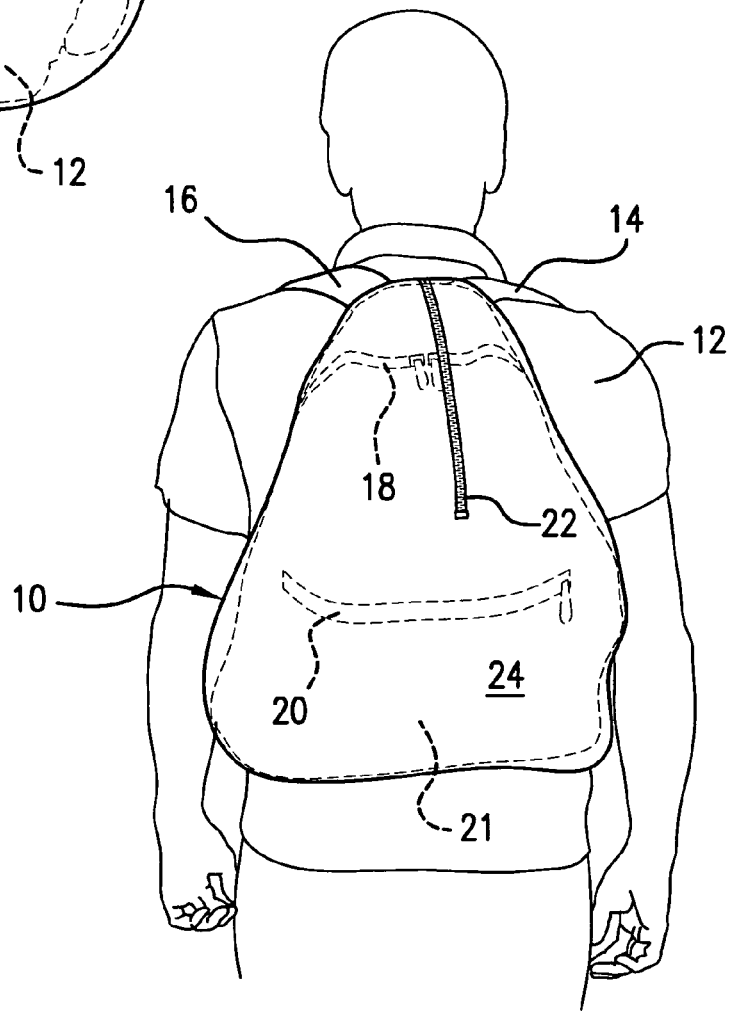
FIG. 2 is a rear elevational view of the cover and backpack of FIG. 1, worn by a traveler.

FIGS. 1 and 2 show protective cover 10, constructed in accordance with the principles of applicant's invention, worn on the back of a traveler. Backpack 12, shown in dotted outline, is received within the interior of cover 10. Backpack 12 is configured in a well-known manner, to receive books, clothes, valuables, food, etc. Backpack 12 usually includes two shoulder straps 14, 16 and two waist straps (not shown in FIGS. 1 and 2), which cooperate to position the backpack on the body of the wearer. Zipper 18, also shown in phantom outline, is provided to open, and close, the interior of the backpack, to receive, or remove, the diverse contents thereof. Smaller zipper 20, also shown in phantom outline, is provided to open, and close, an auxiliary pocket 21 on backpack 12.

Backpacks 12, when secured to the body of the wearer by shoulder and waist straps, situate zippers 18, 20 in a rearwardly facing, and vulnerable position. The zippers 18, 20 are visible to a thief, and may be opened without the wearer, who is facing forward, even realizing same. Also, zippers 18, 20 may provide ready access to the contents of back pack 12, when the back pack is removed, and left unattended.

Security cover 10 defeats such nefarious conduct, however. Protective cover 10 includes a centrally located, elongated zipper 22 that extends from approximately the mid-point of rear section 24 of cover 10 to the mid-point of front section 26 of cover 10. Rear section 24 of cover 10 is visible in FIG. 2, while front section 26 is visible in FIG. 3. Front section 26 of cover 10 is worn against the back of the user, such as a traveler.

Figure 3:
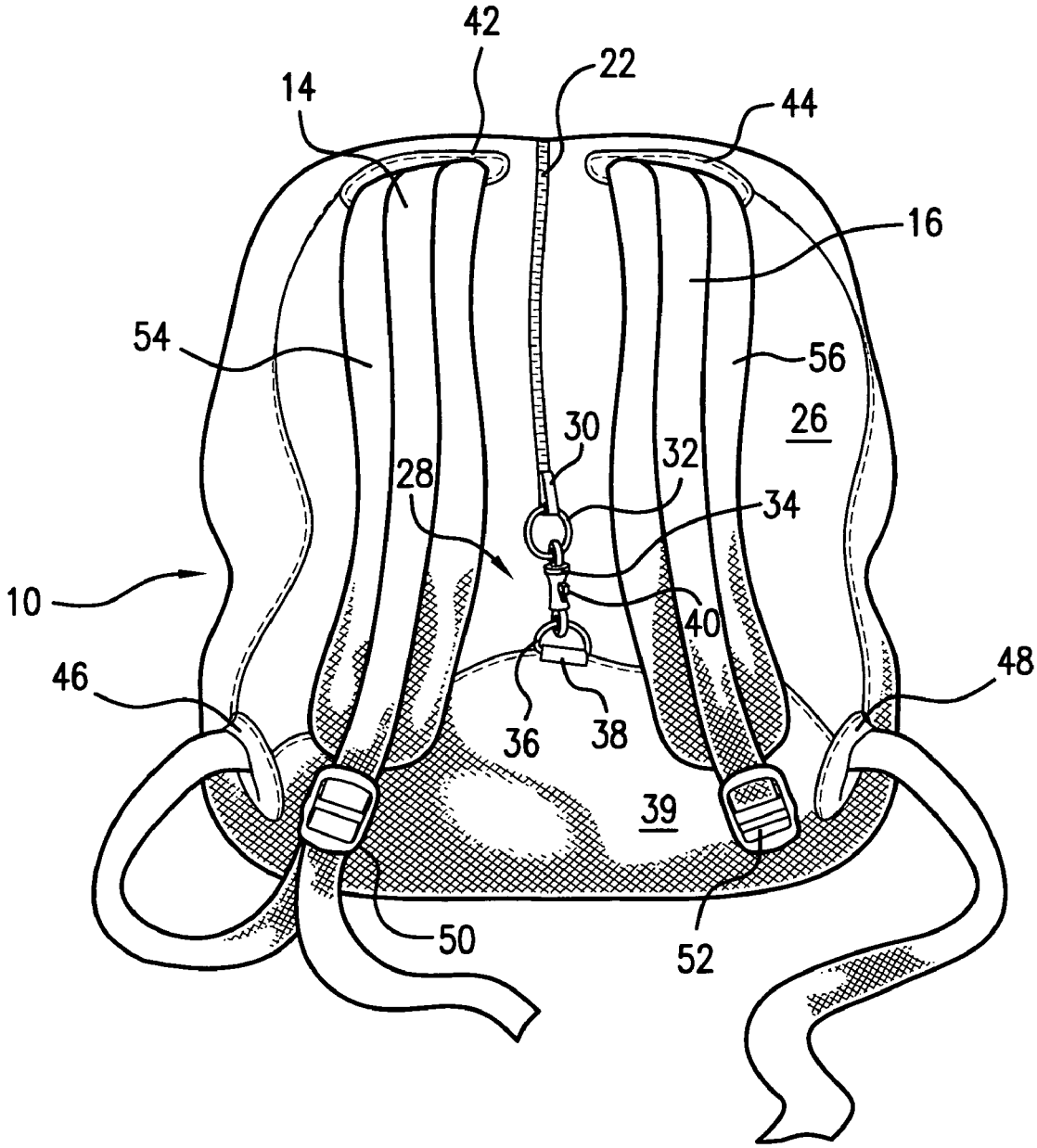
FIG. 3 is a rear view of the cover and backpack; showing the straps and the locking mechanism for the cover.

Elongated zipper 22 is shown in its closed position in FIGS. 2 and 3, protective cover 10 is closed, and access to the interior of security cover 10, and its contents, namely backpack 12, is denied. A locking mechanism, indicated generally by reference numeral 28, retains elongated zipper 22 in closed condition, whether security cover 10 is worn or placed on the ground, unattended.

Locking mechanism 28 includes slider 30, which is grasped by the fingers of the user, to open and close elongated zipper 22. O-ring 32 is slipped transversely through slider 30, and one end of clip 34 is snapped into engagement with o-ring 32. The opposite end of swivel hook 34 is snapped into engagement with D-ring 36, which is retained in fixed position by sleeve 38, which is sewn into flap 39 on rear section 26 of cover 10. Depressing button 40 on swivel hook 34 releases o-ring 32, and frees slider 30. Slider 30 may then be grasped by the fingers of a user, and employed to open, or close, elongated zipper 22.

FIG. 3 shows the manner in which shoulder straps 14, 16 of backpack 12 are employed to retain cover 10, with backpack 12 sealed in its interior, on the body of the traveler. Slots 42, 44 are located near the upper edge of rear face 26 of cover 10; one aperture is situated on each side of major zipper 22. Apertures 46, 48 are defined near the lower edge of rear face 26 of cover 10. Shoulder strap 14 is extended from backpack 12, retained in the interior of cover 10, through slot 42 and returned to the interior of cover 10 via aperture 46. Shoulder strap 16 is extended from backpack 12, retained in the interior of cover 10, through slot 44 and returned to the interior of cover 10 via aperture 48.

Buckle 50 adjusts the length of shoulder strap 14, while buckle 52 adjusts the length of should strap 16. Elongated pad 54 is worn beneath shoulder strap 14, while a similar elongated pad 56 is worn beneath shoulder strap 16, for increased comfort. Slots 42, 44 and apertures 46, 48 may be reinforced by metal bushings, grommets, or extra layers of fabric, to increase the useful life of cover 10.

Figure 4:
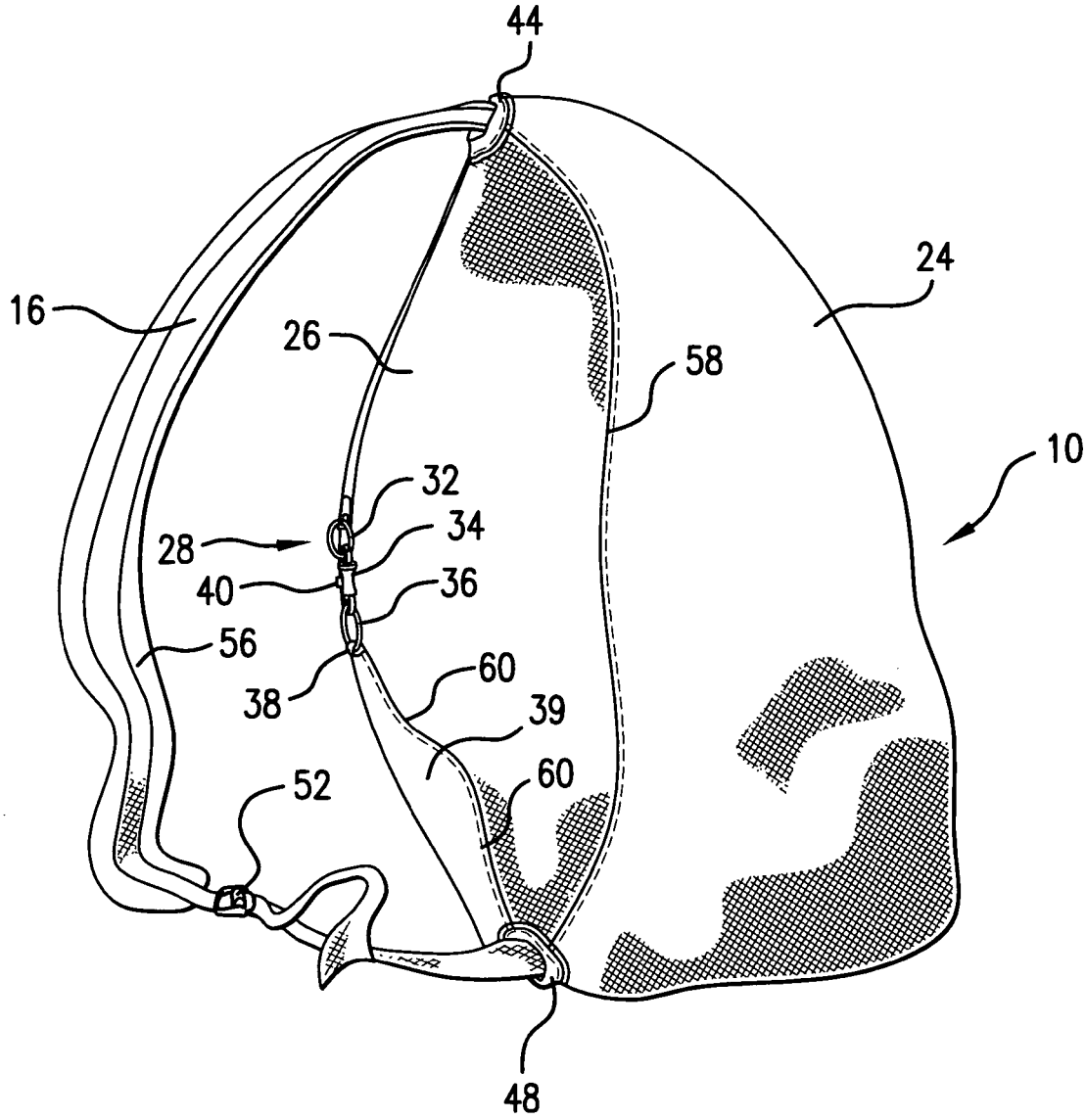
FIG. 4 is a side view of the cover and backpack, showing the straps and the locking mechanism for the cover.

FIG. 4 is a right side, elevational view of cover 10, as shown in FIG. 3. Front section 24 of cover 10 is secured to rear section 26, by sewing, along seam 58. Flap 30 is secured to rear section 26, by sewing, along seam 60.

Figure 5:
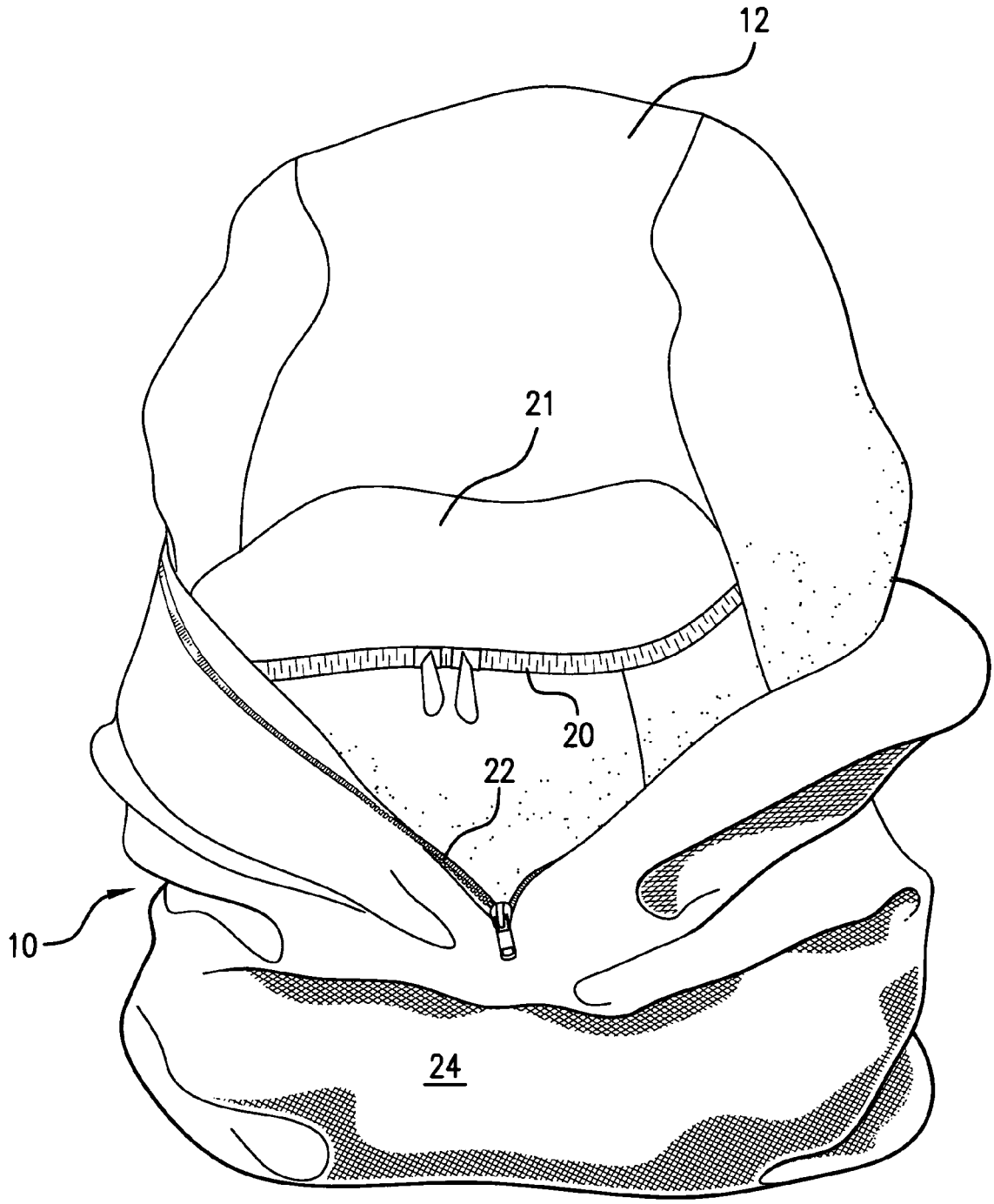
FIG. 5 is a perspective view showing the zipper on the cover in an open position to provide access for the insertion of the backpack.

FIG. 5 shows elongated zipper 22 on cover 10 in its opened condition, providing access to the interior of cover 10. Backpack 12, with auxiliary pocket 21, is visible. Zipper 20, which may open the auxiliary pocket and/or provide access to the interior of backpack 12, is fully exposed.

Figure 6:
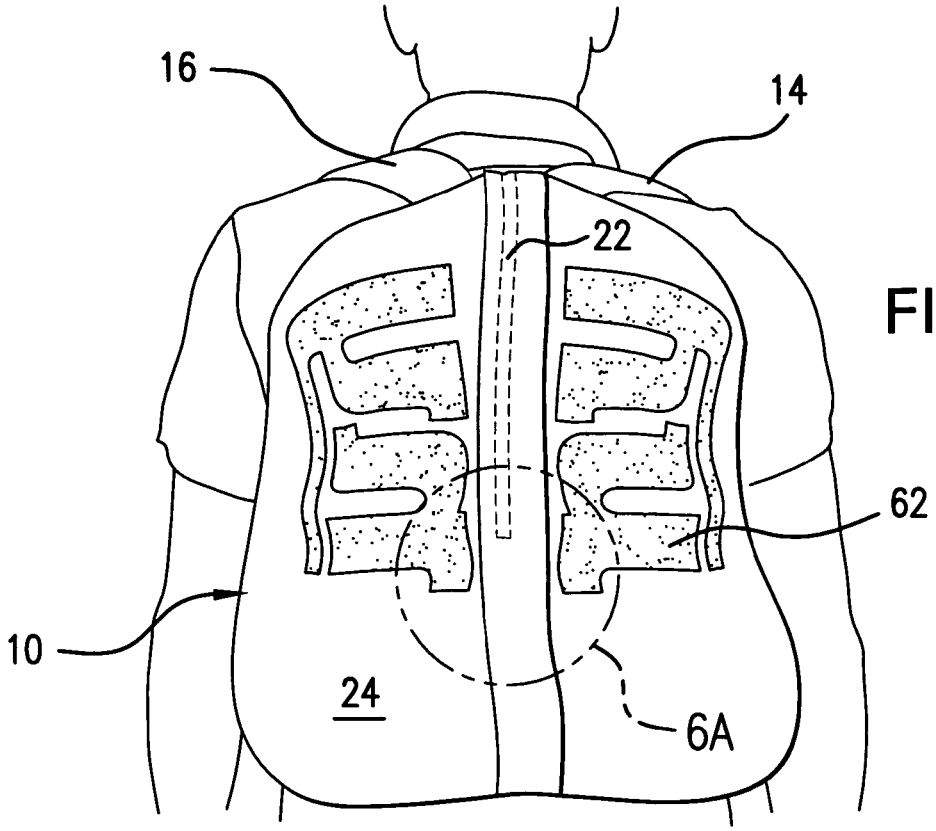
FIG. 6 is a rear elevational view of the cover displaying an advertisement or logo.

FIG. 6 shows a decorative feature 62, such as a team logo 62 that is applied to the exposed, rear face 24 of cover 10. In lieu of a logo, protective cover 10 may be personalized by adding the wearer's name, a unique pattern, or any other decorative feature that the wearer wishes to purchase. Logo 62 may increase the appeal of cover 10, and underwritten support, or revenue, may be secured from the entity associated with the logo, pattern, design, or the like.

Figure 6A:
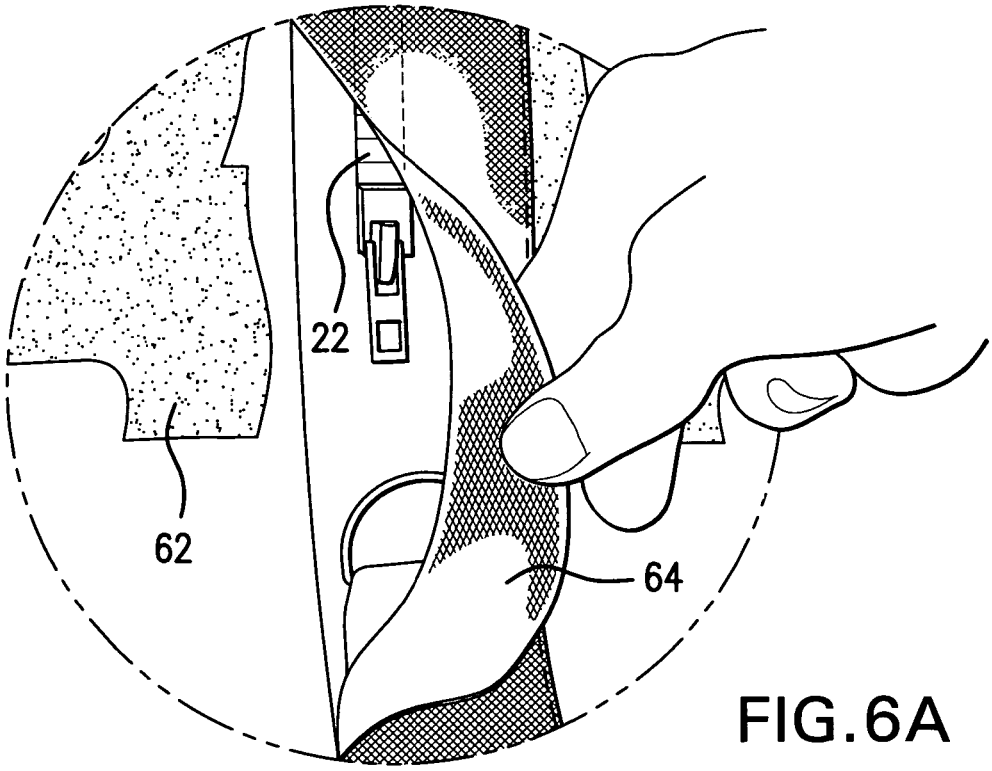
FIG. 6A is a view of a detail of the locking mechanism for the zipper of the cover, such view being taken within zone 6A of FIG. 6, and on an enlarged scale.

FIGS. 6 and 6A also depict security flap 64 that conceals elongated zipper 22 and slider 30. Security flap 64 is sewn to rear section 24 along seam 66, and must be pulled back, or pivoted, to expose elongated zipper 22. Security flap 64 may be color coordinated with the fabric used for the remainder of cover 10, so that cover 10 appears to be a unitary bag without any visible point of attack.

Protective cover 10 may be formed of a variety of strong, wear resistant fabrics; furthermore, the fabrics may be treated to be water repellant or water resistant. The number of sections sewn together to form cover 10, may be altered. Other modifications and revisions to applicant's cover may occur to the skilled artisan in the relevant fields of endeavor. Consequently, the appended claims should be broadly construed in a manner consistent with applicant's inventive efforts, and the claims defining applicant's invention should not be limited in scope to their literal terms.

What is claimed is:

1. A protective bag for securing the contents of a backpack, said protective bag comprising:

a) a front section and a rear section secured together to form a closed bag, the front section adapted to be positioned adjacent to the body of the user while the rear section is exposed, b) an elongated zipper extending in a vertical plane from approximately the midpoint of the rear section to the mid-point of said front section over said front and rear sections, c) a slider for opening said zipper to expose the interior of said bag, d) said bag, when opened, being adapted to receive a backpack, including shoulder straps, therein, e) a plurality of slots formed adjacent one end of said rear section, f) a like plurality of apertures formed in the vicinity of an opposite end of said rear section, g) said slots and apertures adapted to receive the straps on the backpack so that said protective bag can be worn on the shoulders of the user, h) a locking mechanism is provided on the front section of the bag for retaining the slider in closed position, and i) said locking mechanism includes a first ring depending from said slider, a hook with an upper and lower end, and a second ring, j) the upper end of said hook secured to said first ring and the lower end of said hook secured to said second ring, k) said locking mechanism further including a flap secured to the opposite end of said rear section of said bag, and l) a collar located at an upper end of said flap to receive said second ring.

2. A protective bag with a locking mechanism as defined in claim 1, wherein a button is located on said hook, said button, when depressed, releasing said hook from said first ring so that said slider may be moved to open said elongated zipper.

3. A protective bag as defined in claim 1, wherein said plurality of apertures consists of two apertures, one aperture located on each side of said elongated zipper.

4. A protective bag as defined in claim 1, wherein said plurality of slots consists of two slots, one slot located on each side of said elongated zipper.

5. A protective bag as defined in claim 1, wherein a security flap extends over the entire length of said elongated zipper, said security flap normally concealing said zipper from view.

6. A protective bag as defined in claim 1 wherein said first ring is an O-ring, and said second ring is a D-ring, and said hook is a swivel hook.

* * * * *